US005664738A

United States Patent [19]

Fife

[11] Patent Number: 5,664,738

[45] Date of Patent: Sep. 9, 1997

[54] PNEUMATIC WEB GUIDE

[76] Inventor: Robert L. Fife, P.O. Box 136084, Ft. Worth, Tex. 76136

[21] Appl. No.: 649,226

[22] Filed: May 17, 1996

[51] Int. Cl.[6] ..... B65H 26/00; B23Q 15/00

[52] U.S. Cl. ..... 242/563.1; 226/19; 226/23; 226/45

[58] Field of Search ..... 226/19, 22, 23, 226/45; 242/534.1, 563.1; 137/485; 251/25

[56] References Cited

U.S. PATENT DOCUMENTS

| | | | |
|---|---|---|---|
| 1,615,415 | 1/1927 | Tandel | 226/22 |
| 2,331,030 | 10/1943 | King | 226/22 |
| 2,814,487 | 11/1957 | Medkeff | 226/19 X |
| 3,727,817 | 4/1973 | Tibavido | 226/19 |
| 3,750,920 | 8/1973 | Fountain et al. | 226/23 |
| 3,908,881 | 9/1975 | McCann | 226/19 |
| 4,073,448 | 2/1978 | Kolosov | 226/19 X |
| 4,629,061 | 12/1986 | Crandall | 226/23 X |
| 4,655,378 | 4/1987 | DuFour | 226/23 |
| 4,666,073 | 5/1987 | DuFour | 226/23 |

*Primary Examiner*—Michael Mansen

*Attorney, Agent, or Firm*—Gifford, Krass, Groh, Sprinkle, Patmore, Anderson & Citkowski, P.C.

[57] ABSTRACT

A positive pressure operated control apparatus for lateral alignment of a continuous web of paper, plastic, textiles and other materials which are being processed at windup, unwind, printing, coating, folding and slitting stations, or other intermediate points in the machine process. The apparatus includes an air source communicating with a combination sensor and controller which regulates a double-acting air actuator having an output member to move a web positioning assembly. The controller is regulated by a sensor paddle which is spring loaded to be maintained in engagement with the web edge. As the web wanders or becomes misaligned, the paddle moves in proportion to the misalignment and results in movement of a valve element relative to two orifice openings to provide differential air pressure proportional to error to operate the actuator to produce actuator movement proportional to the error to correct the position of the web.

20 Claims, 1 Drawing Sheet

PNEUMATIC WEB GUIDE

The present invention relates to web guiding apparatus and more particularly to control apparatus utilizing fluid pressure.

Web stock is typically wound on rolls from which it is unwound as a continuous web and conveyed into printing, slitting, gluing, folding, laminating and similar equipment which require precise lateral alignment. Because these webs are fed at high rates of speed, creating a dusty environment, optical and open-pneumatic sensors do not always operate properly due to dust buildup on the photo lens and other web contaminants, such as adhesives and coatings that may obstruct the pneumatic orifices. Vacuum-operated systems are susceptible to dust and other contaminates, requiring maintenance of additional pump and sensor intake filters. Web contacting controllers overcome many of these problems and are well suited for this purpose. However, web contacting systems usually use single-acting actuators which are spring-opposed to make the web alignment corrections. This results in a spring force in one direction and modulated pressure in the other direction. As a result of a different force in each direction, the system's null point changes over the actuator stroke, limiting the effectiveness to accurately guide to a predetermined point. This is particularly true under heavy loads and long actuator strokes.

Prior art systems which attempt to control pressures in the opposed chambers of double-acting actuators become complex and rely on electric or hydraulically operated servo motors in addition to sensors. The patent to Tibavido, 3,727,817 for example, discloses the use of a double-acting actuator to make web position corrections but the pressure generated at the sensor is too low to directly control an actuator and it becomes necessary to amplify the force by employing pressure responsive means to generate electrical signals to operate on-off solenoid valves controlling the delivery of system pressure to the actuator. Such on-off valves preclude modulated control and the system is too complex to combine the needed components in a single assembly.

Another example of the use of double-acting actuators in the control of web position is found in the patent to Kolosov 4,073,448. In that system, pressure is always maintained at a selected constant in the same chamber and is modulated in the opposite chamber to a level higher or lower than the selected constant pressure. The differences in speeds of operation in opposite directions must be adjusted by separate throttle valves. In one embodiment pressures can be modulated in both chambers, but two sensors are required with one being associated with each of the two edges of a web. Proper operation requires webs of constant or uniform width.

SUMMARY OF THE INVENTION

It is an object of the invention to provide a web guide system utilizing a compact controller and sensor assembly which can be easily supported in close proximity to the web and which responds to the position of a web to modulate the pressure in one or the other pressure chambers of a double acting actuator to make web alignment corrections.

It is another object of the invention to provide a web guiding system in which the compact controller and sensor assembly incorporates both the web contacting sensor and a control valve to make the necessary web position corrections directly without the need of additional servo mechanisms, pressure amplifiers, solenoids or electrical controls.

It is a further object of the invention to provide a web guide system in which the controller incorporates a mechanical sensor that responds to any changes in web position to make rapid corrections by way of a double acting actuator which makes corrections uniformly in both directions of operation.

Another object of the invention is to provide a web guide system in which sensitivity of the sensor and controller assembly can be varied to accommodate a range of webs from flexible to relatively stiff webs.

Another object of the invention is to provide a system in which the actuator moves with the same velocity and force regardless of the starting position of the actuator output rod.

The purposes of this invention are accomplished by utilizing an air pressure source, such as a compressor, which is connected to a double acting, pneumatic actuator engaged to laterally move either the unwinding or rewinding rolls or adjacent web positioning guide roller equipment in response to pressure changes. The pressure to the actuator is regulated by a combined sensor and control assembly having a spring-loaded feeler or paddle acting as a sensor contacting the web edge to follow any lateral movement of the web and operating to correspondingly move a control valve which forms the controller. The spring-loaded, web engaging sensor is mechanically connected to and operates to move a valve which regulates the size of two exhaust orifices. In one version the valve orifices are overlapped and depending on the sensor alignment, the control valve meters or modulates the exhaust pressure from one of the chambers of the double-acting actuator, while the other chamber is maintained at system pressure to cause movement of the actuator. In another version, the valve orifices are under-lapped and pressure is initially modulated in both chambers of the actuator. In this manner, the deflection of the sensor blade results in proportionate movement of the control valve and therefore the actuator to correct any web edge misalignment.

The two-orifice arrangement of the controller in combination with the double-acting actuator result in the same force and velocity in the two directions of movement of the actuator for any given displacement of the sensor from a null position and from any starting position of the actuator stroke. Also, this allows all of the control pressure to be applied to the double-acting actuator in either direction of operation without being reduced by an opposing spring. This makes operation of the system the same in either direction of movement of the actuator and the same for any starting position of the actuator stroke.

The controller and sensor assembly itself include a rotary valve movably directed by the web engaging sensor. The valve has two matched exhaust vents, one associated with one direction of the sensor movement, and the other with the other direction of sensor movement. The arrangement of the sensor-controller assembly formed by the rotary vane and sensor allows for a compact, low inertia structure that can respond to high rates of change in the web alignment. Furthermore, the effectively massless character of the pneumatic circuit, together with the edges or shapes in the various orifices, produce a dumped controller arrangement which is limited only by the inertia of the feeler-operated valve. Direct communication between the sensor-controller and double-acting actuator without requiring additional servo mechanisms or amplifiers provides several distinct advantages to system users in the form of low cost, simple installation, low maintenance, low air consumption, good system response and accuracy, and efficient operation of existing air pressure systems.

DETAILED DESCRIPTION

Figure 1:
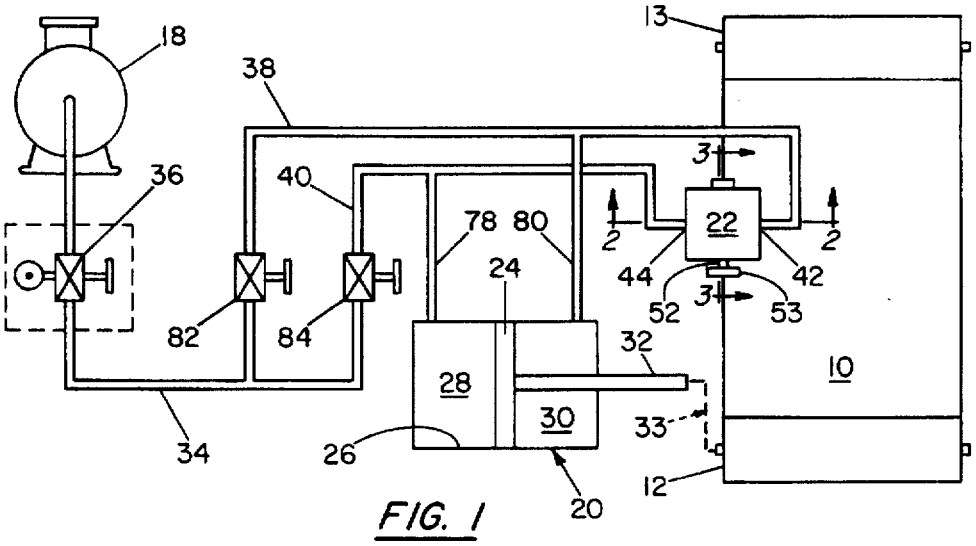
FIG. 1 is a diagrammatic view of a web controlled system embodying the present invention.

The apparatus of the pneumatic web guide system of the present invention is used in association with a moving web indicated generally at 10. Such a web may be in the form of paper, tape, cloth, foil, plastics or other flexible materials. By way of example, the web 10 may move longitudinally between a supply roll 12 and a take up roll 13. During such movement, the web 10 may shift laterally because of misalignment of the material wound on the roll 12. Such misalignment of the web 10 can be adjusted or corrected by shifting the supply roll 12 laterally in proportion to the sensed misalignment. This forms the guide means for correcting the path of web 10. Also, the lateral position of web 10 can be corrected at intermediate points of the moving web by changing the angular position of a guide roller (not shown) in contact with the web 10. Such guide rollers form parts of web guide arrangements for maintaining webs in a predetermined path and are available commercially in many forms.

The lateral position of the web 10 is controlled automatically by a web control system, the principle components of which are an air compressor 18 for a continuous supply of compressed air, a double acting actuator 20 operatively connected to supply roll 12 to move it axially and a combined sensor-controller 22 which responds to the lateral position of the web 10 to control the operation of the actuator 20 to bring about corrective movement of the roller 12 and therefore the lateral position of web 10.

The actuator 20 is of the double acting type and incorporates a moveable wall in the form of a piston 24 in a cylinder 26 and forming a pair of air pressure chambers 28 and 30 at opposite sides of the piston 24. The piston 24 is connected through a rod 32 to various linkages and mechanism indicated generally at 33 to bring about lateral movement of the supply roll 12. A variety of apparatus responsive to the movement of an actuator 20 is available to bring about such corrective movement of a supply roll 12. Similarly, actuator 20 can be used in association with rewind rolls or web guide mechanism at intermediate points of a web.

The output of the air compressor 18 is supplied through a conduit 34 and through a pressure regulator 36 to branch conduits 38 and 40 to inlet ports 42 and 44, respectively, of the controller and sensor assembly 22.

The controller 22 is mounted in a fixed but adjustable position relative to one edge of the web 10. The assembly 22 includes controller valve 45 having housing 46 mounted on a bracket 47 and forming a cylindrical cavity 48. The cylindrical cavity 48 receives a valve rotor 50 which is guided in the cavity 48 for rotation with a shaft 52 extending axially of the rotor 50 and projecting through one end of the housing 46. The sensor portion of the assembly 22 is designated at 51 and includes a hub 53 on the exposed end of shaft 52 supporting a radially extending arm 54. The hub 53 is adjustably fixed to the shaft 52 by a set screw 55. The free end of arm 54 is provided with a paddle 56 which engages the edge of the web 10.

Figure 3:
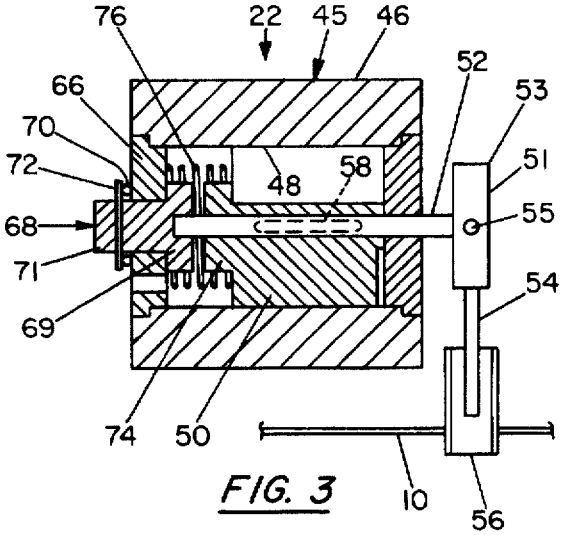
FIG. 3 is a cross-sectional view similar to FIG. 2 taken on line 3—3 in FIG. 1.
Figure 4:
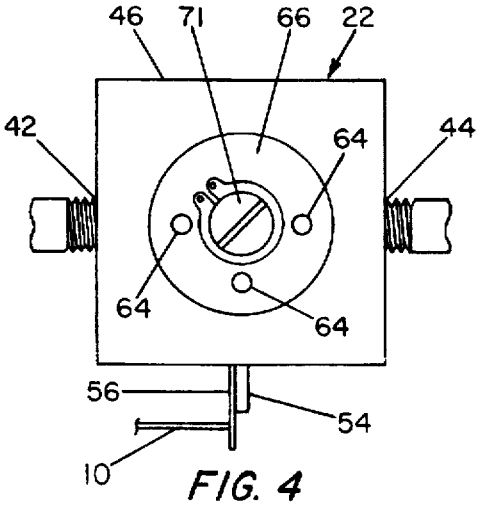
FIG. 4 is an end elevation of the sensor-controller mechanism from the left as viewed in FIG. 3.
Figure 5:
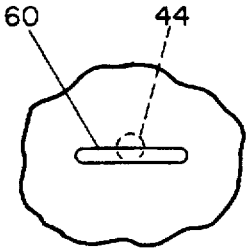
FIG. 5 is a broken away sectional view taken on line 5—5 in FIG. 2.

The valve rotor 50 is shaped to control the effective sizes of exhaust orifices 58 and 60 associated with ports 42 and 44, respectively. The orifices 58 and 60 are in the form of identical elongated slots formed in the wall of housing 46 and placing the cylindrical cavity 48 in communication with the ports 42 and 44. The position of slot 58 is indicated in FIG. 3 and slot 60 in FIG. 5. The slots or orifices 58 and 60 are controlled by the semi-cylindrical valve rotor 50. In the preferred embodiment, rotor 50 forms two control edges 61 positioned to slightly overlap orifices 58 and 60 and maintain them closed in the null position. Under that condition, air under pressure supplied through the conduits 38 and 40 is available at the ports 42 and 44. Upon opening of one of the exhaust orifices 58 or 60 air is communicated to valve cavity 48 from which it is exhausted to the atmosphere through one or more exhaust ports 64 formed in the end plate 66 of housing 46 as seen in FIGS. 3 and 4.

Alternatively, and at the expense of greater consumption of air, the control edges 61 can be positioned in an underlapped condition so that in the null position, the orifices 58 and 60 are both slightly open. In that case, the pressure is initially modulated in both chambers 28 and 30 of the actuator 20 as the valve rotor 50 is rotated in response to lateral travel of the web.

The end plate 66 supports a bushing 68 which is rotatable to selected positions relative to the end plate 66. The bushing 68 includes an annular flange 69 disposed in valve chamber 48 and is held in position relative to the end plate 66 by means of an elastomeric O-ring 70 and snap ring 72 seated on a shaft 71. The O-ring 70 acts between snap ring 72 and end plate 66 to offer resistance to rotation of the bushing 68 so that it is maintained in any selected position to which it is rotated relative to end plate 66. Such selected positions are accomplished by manually rotating shaft 71 a selected amount.

The valve rotor 50 is provided with a circular flange 74 of the same size as the adjacent flange 69 of bushing 68. A coil spring 76 has one of its ends anchored in the rotor flange 74 and the other end anchored in bushing flange 69. Rotation of the bushing 68 to a selected position determines the spring load and the resistance to movement of the rotor 50 and the amount of force urging the paddle 56 against the edge of web 10. This offers an adjusting means by which the paddle force of the sensor 51 can be regulated from a relatively high force to a minimum to accommodate webs ranging in stiffness from a maximum to a minimum.

The inlet ports 42 and 44 are connected to the compressor 18 through branch conduits 38 and 40. Each of these lines also is connected to one of the chambers 28 and 30 by way of lines 78 and 80 respectively. If the lateral position of the web 10 is not changing, the controller assembly 22 is in its null position illustrated in FIG. 2, that is, both exhaust slots 58 and 60 are closed or equally open. At the same time, the paddle 56 is in engagement with the edge of the web 10 while the web 10 is traveling in a desired path under the control of actuator 20. The actuator 20 has its piston at an intermediate position of its stroke. The same air pressure available in the conduits 38 and 40 also will exist in the chambers 28 and 30 of the actuator 20. Throttle valves 82 and 84 are provided in the branch conduits 38 and 40 so that the entire system can be calibrated to establish the pressure level that exists in the actuator chambers 28 and 30 and to establish the null or starting position of the paddle 56 against the web 10.

In the event that the web 10 strays from its desired path, paddle 56 will be caused to follow the movement of the web 10 to swing the arm 54 and move shaft 52 so that the rotor 50 rotates to maintain one of the orifices 58 or 60 closed and at the same time to open the other of the orifices 60 or 58, a predetermined amount. Closing one orifice completely and regulating the size of the opening of the opposite orifice will determine the amount of air that can be exhausted through the open orifice. For example, if the web 10 should move to the left as viewed in FIG. 1, the paddle 56 in FIG. 3 will also move causing the rotor in FIG. 2 to move clockwise. Orifice 60 will continue to be closed and the orifice 58 will be increased in size. As a result, air at port 42 and in line 38 will be exhausted so that the pressure at port 42 will be lower than at port 44 and in line 40, as a result chamber 28 will be at a higher pressure than cylinder chamber 30. This pressure differential causes the piston 24 to move to the right, as viewed in FIG. 1, so that the piston rod 32 moves the supply roll 12 axially to the right to return the web 10 to the right toward its original path. As the web 10 approaches its original lateral position, the spring 76 causes sensor 56 to remain in engagement with web 10 and to move valve rotor 50 toward its original null position to close both of the orifices 58 and 60 and prevent any additional exhaust of air.

Figure 2:
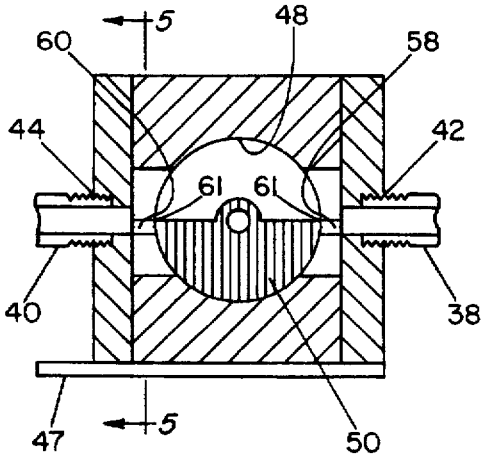
FIG. 2 is a cross-sectional view at an enlarged scale taken on line 2—2 in FIG. 1 of the sensor-controller mechanism used in association with the web.

If the web 10 should stray in the opposite direction, that is to the right, as viewed in FIG. 1, coil spring 76 will maintain the paddle 56 in engagement with the edge of the web so that the valve rotor rotates in a counter clockwise direction as viewed in FIG. 2 to increase the size of orifice 60 and increase the overlap of closed orifice 58. This results in a greater pressure in actuator chamber 30 than in actuator chamber 28 so that the piston 24 moves toward the left as viewed in FIG. 1 to bring about leftward movement of the web 10 to its original position.

The resistance to movement of rotor 50 is substantially the same in opposite directions and as a result, the pressures are decreased or modulated in one chamber 28 or 30 to bring about the necessary corrective movement of the actuator 20. As a consequence, control of movement of the web is equal in opposite directions.

Throttle valves 82 and 84 located in the branch lines 38 and 40, respectively, can be adjusted relative to each other to insure that the proper pressure level is established in each of the lines 38 and 40 and, therefore, in the chambers 28 and 30 of the actuator 20 to maintain the position of the supply roll 12 in the necessary location to establish the predetermined path of the web 10.

Once the throttle valves 82 and 84 are set to determine the null position of the sensor and reference point of the web, the pressure regulator can be adjusted to select the maximum pressure of the system. By way of example, the pressure regulator 36 could be set at 5 psi when the force required to bring about corrections in the position of the path of the web are relatively low and at some higher level, such as 15 psi, for example, when larger corrective force of the actuator 20 is needed. At any system pressure level the corrections made to the path of the web are proportional to the movement of the web from its selected path and are equal in opposite directions.

A web guide system has been provided which relies on a web position sensor in direct contact with the edge of a web to directly move a control valve to modulate the exhaust pressure from one chamber or the other of a double-acting actuator which moves in response to the differential pressure to bring about corrective movement to the web with such corrective movement being equal to the amount of error. The only components required are a combined controller valve and sensor assembly, a double-acting actuator and a source of air pressure interconnected by air lines without the need of any electrically or hydraulically controlled components or servo mechanisms.

I claim:

1. Apparatus for maintaining a traveling web of material in a predetermined path comprising:

actuator means for moving said web transversely, said actuator means having a pressure responsive moveable wall and a pair of chambers formed at opposite sides of said wall, sensing means movable in response to a change in the transverse position of said web, a source of fluid pressure, a pair of conduits, each conduit continuously communicating said source of pressure with one of said chambers, a rotatable controller communicating with said pair of conduits and being operative to prevent the exhaust of fluid pressure from said pair of conduits to the atmosphere when said web is in said predetermined path and being rotatable in response to movement of said sensing means to modulate the exhaust of fluid from and reduce the pressure in one of said chambers when said web moves from said predetermined path to cause a decrease in pressure in said one of said chambers below the pressure existing in the other of said chamber to cause movement of said moveable wall and corresponding movement of said web to return said web to said predetermined path.

2. The apparatus of claim 1 wherein said sensing means includes a sensing element engageable with one edge of said web.

3. The apparatus of claim 2 wherein said sensing element and said rotatable controller are connected directly to each other.

4. The apparatus of claim 2 wherein said sensing element is maintained in continuous engagement with said web during movement of the web.

5. The apparatus of claim 2 further comprising a spring urging said sensing element into continuous engagement with one edge of said web.

6. The apparatus of claim 2 wherein said controller includes a valve member connected to said sensing element for rotational movement thereby to control communication of said pair of conduits with said pair of chambers, respectively.

7. The combination of claim 6 wherein said valve member is rotatably supported for movement about a shaft extending generally parallel to the direction of movement of said web.

8. The apparatus of claim 1 wherein said controller includes a pair of control ports associated with said pair of conduits, respectively, a pair of control surfaces moveable simultaneously relative to said control ports in a first direction maintaining one of said ports closed and opening the other of said ports and in a second direction opening said one port and maintaining said other of said ports closed.

9. The apparatus of claim 1 further comprising a pair of throttle valves disposed in said pair of conduits, respectively to regulate the pressure in said conduits.

10. The apparatus of claim 1 wherein said moveable wall is a piston.

11. Apparatus for maintaining a traveling web of material in a predetermined path comprising:

a double-acting actuator for moving said web, said actuator having a pressure responsive moveable wall forming a pair of chambers at opposite sides of said wall, a controller assembly having a sensor means in continuous engagement with an edge of said web, a source of fluid pressure, a pair of conduits continuously communicating said source of pressure with said controller assembly, said controller assembly being operative in a first position to prevent exhaust of fluid pressure from both of said conduits to the atmosphere when said web is in said predetermined path, said controller assembly including a rotatable valve element movable by said sensor means in one direction from said first position to modulate the exhaust of pressure from one of said conduits and to prevent the exhaust of pressure from the other of said conduits when said web moves in one direction from said predetermined path and being moveable in an opposite direction from said first position to prevent the exhaust of pressure from said one of said conduits and to modulate the exhaust of pressure from the other of said conduits when said web moves in the other direction from said predetermined path, said pair of chambers of said actuator being in separate communication with said pair of conduits, respectively, whereby exhaust of pressure from either of said conduits while maintaining pressure in the other of said conduits causes movement of said moveable wall and corresponding return movement of said web to said predetermined path.

12. The apparatus of claim 11 wherein said controller assembly includes, a pair of control ports communicating with said pair of conduits, respectively, and a rotatable valve element connected to said sensor means and controlling the opening and closing of said ports, said valve element being rotatable from a position in which said ports are both closed to a position in which one port remains closed and the other port is open in proportion to the movement of said web.

13. The apparatus of claim 12 and further comprising resilient means urging said valve element in one direction to urge said sensor means into continuous engagement with the edge of said web.

14. The combination of claim 13 wherein said resilient means is a torsion spring acting between said rotary valve element and a housing member.

15. The apparatus of claim 12 wherein said rotary valve element is supported for movement about an axis generally parallel to the direction of web movement.

16. The apparatus of claim 12 wherein said rotary valve element is mounted in a housing and wherein said resilient means is a torsion spring acting between said rotary element and said housing.

17. The apparatus of claim 16 and further including means for selectively adjusting the force applied by said torsion spring.

18. Apparatus for maintaining a traveling web of material in a predetermined path comprising:

a double-acting actuator for moving said web, said actuator having a pressure responsive movable wall forming a pair of chambers at opposite sides of said wall, a controller assembly including a sensor and a rotary control valve element, said sensor being movable to remain in engagement with said web during all lateral movement of said web and being directly connected to said control valve element to correspondingly rotate said valve element, said valve element having a pair of ports, a source of fluid pressure, first conduit means maintaining said source in continuous communication with one of said actuator chambers and one port of said pair of ports, second conduit means maintaining said source of fluid pressure in continuous communication with the other of said actuator chambers and the other port of said pair of ports, said rotary valve element having an initial position in which both of said ports are closed and being movable in a direction and for a distance corresponding to the movement of said web from said predetermined path to maintain one port closed and open the other port to exhaust air from the associated one of said first or second conduits whereby air is exhausted from the associated one of said chambers of said actuator to cause movement of said movable wall and corresponding return movement of said web to said predetermined path.

19. The apparatus of claim 18 wherein said sensor is mounted on said valve element for swinging movement on the same axis as said rotary valve dement.

20. The apparatus of claim 18 and further comprising resilient means urging said sensor into engagement with the edge of said web.

* * * * *